United States Patent [19]

Bush

[11] 3,964,169

[45] June 22, 1976

[54] GARMENT FITTING AID

[76] Inventor: Roberta F. Bush, 232 Sierra Drive, Walnut Creek, Calif. 94596

[22] Filed: Sept. 23, 1974

[21] Appl. No.: 508,552

[52] U.S. Cl. ..... 33/15; 33/174 D; 33/175

[51] Int. Cl.[2] ..... A41H 1/02

[58] Field of Search ..... 33/11, 15, 174 D, 174 G, 33/105, 2, 175, 176, 177; 74/248, 249

[56] References Cited

UNITED STATES PATENTS

| | | | |
|---|---|---|---|
| 615,133 | 11/1898 | Bienenzucht | 63/4 |
| 713,255 | 11/1902 | Traut | 33/105 |
| 938,280 | 10/1909 | Sextone | 33/2 R |
| 1,078,087 | 11/1913 | D'Orsogna et al. | 33/15 |
| 1,130,072 | 3/1915 | Donovan et al. | 33/176 |
| 1,248,035 | 11/1917 | Taylor | 33/2 R |
| 2,052,381 | 8/1936 | Chernow | 63/4 |

*Primary Examiner*—Richard E. Aegerter
*Assistant Examiner*—John W. Shepperd
*Attorney, Agent, or Firm*—John R. Murtha

[57] ABSTRACT

A garment fitting aid or device is made from a plurality of links pivotally joined together to form a chain of links with two free ends, the chain having first and second series or sets of links with curved edge portions at one side, and shorter intermediate links with curved edge portions at opposite sides whereby the intermediate links may be folded back upon themselves to shorten the length of the chain. In use, the links are pressed against the body of the person being fitted and the body contour curves so obtainable are then used to redraw the appropriate seam curves on a garment sewing pattern.

1 Claim, 10 Drawing Figures

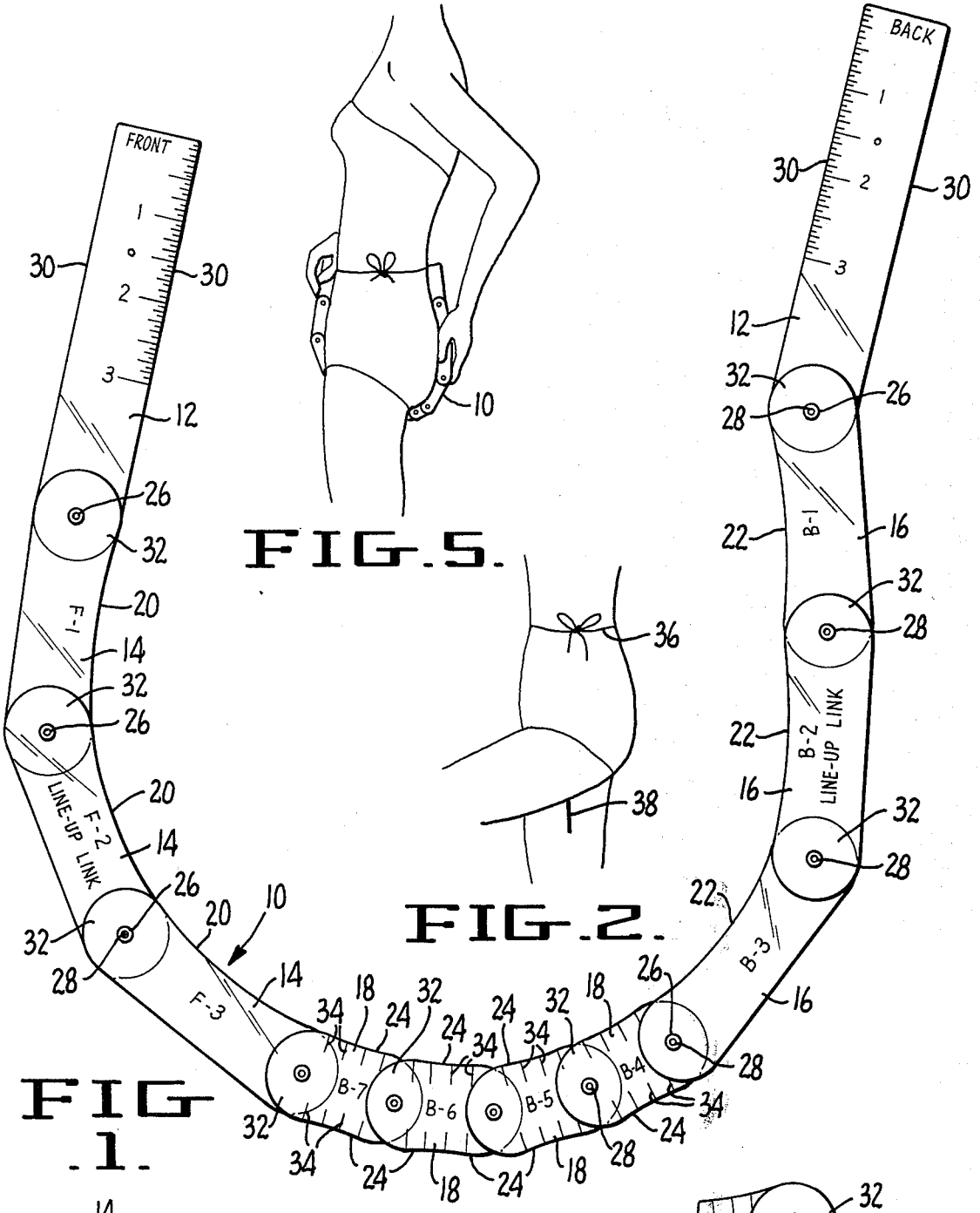
FIG. 1.
FIG. 2.
FIG. 5.
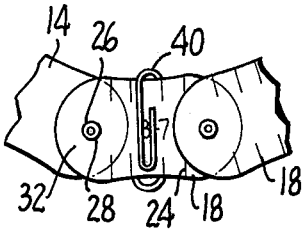
FIG. 3.
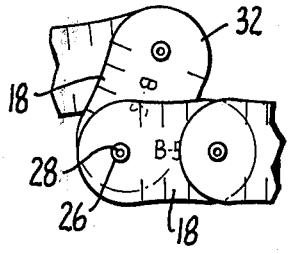
FIG. 4.

GARMENT FITTING AID

The invention relates to a garment fitting aid for adjusting standard pants patterns to achieve a better fit through the crotch.

Devices for determining body contours have been used in the past in the making of dress forms and for altering patterns. See, for example, U.S. Pat. No. 1,078,087 to D'Orsogna et al. and U.S. Pat. No. 938,280 to Sextone. The prior art devices, however, have not won much acceptance from the sewing public. Yet the need for such fitting devices is even greater than ever because of the large number of women who sew clothes for themselves and other members of their families.

The present invention has for its object a garment fitting aid which is inexpensive, simple to use and accurate in result. It is a particular object of the invention to provide a garment fitting aid that is especially suited for achieving an accurate fit for pants patterns.

Briefly, and in general, the invention comprises a garment fitting device composed of a plurality of links pivotally joined together to form a chain having two free ends. A first and second series of links are provided having curved edge portions adapted for engagement with the body of the person to be fitted. In between said links are intermediate links that are shorter in length and that have opposite edge portions formed to the same curvature to enable the intermediate links to be folded back upon themselves and thereby vary the length of the chain.

In the drawings:

FIG. 1 is a plan view of a preferred form of applicant's garment fitting aid;

FIG. 2 is a partial side view of a human torso showing the important areas of reference for properly locating the garment fitting aid to the body;

FIG. 3 is a plan view of one link in the garment fitting aid;

FIG. 4 is a partial view showing how the intermediate link members may be folded back upon one another;

FIG. 5 is a partial side view showing how the garment fitting aid is applied to the body.

Figure 6:
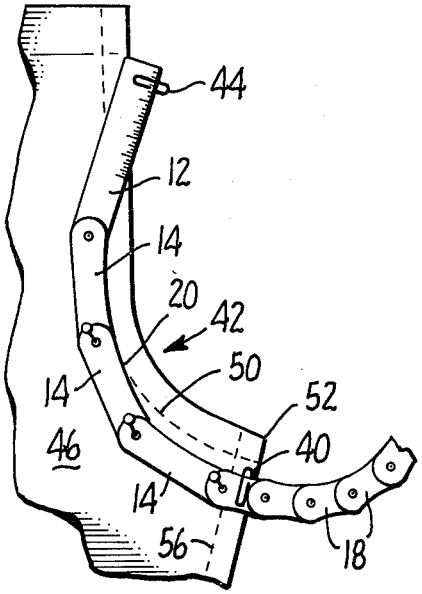
FIGS. 6–10 are plan views of the garment fitting aid applied to a pattern showing how the garment fitting aid may be utilized to alter a pants pattern to provide a more accurate fit.

As will best be seen by reference to FIG. 1, applicant's garment fitting aid 10 comprises a plurality of links 12, 14, 16, 18 pivotally joined together so as to form a chain of links with two free ends. The chain of links has a first series of links 14 with curved edge portions 20 adapted for engagement with the front lower torso of the body of the person being fitted. In the preferred form of the invention there are three links 14 and each is provided with reference indicia beginning with the letter F to indicate that these links are to be applied to the front of the body. Accordingly, the links 14 are designated links F-1, F-2 and F-3.

A second series of links 16 is also provided as part of the chain. The links 16 are intended for engagement with the back torso portion of the body of the person being fitted. Like links 14, the links 16 are provided with reference indicia beginning with the letter B to indicate that they are to be applied to the back of the body. Accordingly, the links 16 are designatedlinks B-1, B-2 and B-3. As in the case of the links 14, the inner edge portions 22 of the links 16 are gently curved.

A plurality of intermediate links 18 are provided in the chain between the links 14 and 16. Each of the intermediate links 18 is substantially shorter in length than the links 14, 16 and have the same curvature at their opposite edge portions 24.

At each free end of the chain is a terminal link 12 that is provided with reference markings in the form of ruler divisions. These links 12 are utilized to locate the garment fitting aid 10 relative to the waist of the person bein fitted.

The links 12, 14, 16, 18 are pivotally and frictionally joined together by eyelets 26 formed adjacent the ends. It is preferred that the eyelets 26 be formed with openings 28 that pass completely through the links so as to provide access holes whereby said garment fitting aid 10 may be pinned to a suitable working surface as is more fully described hereinafter. The pressure of the eyelets 26 on the links in the chain is sufficient to provide a frictional force that will permit relative movement of the links without difficulty yet, at the same time, present sufficient resistance to movement that the garment fitting aid 10 may retain its shape after application to the body of the person being fitted. It is preferred that the garment fitting aid 10 be made from a suitable transparent plastic as this construction permits the user of the device to see through it when it is applied to a pattern.

The terminal links 12 at the free ends of the chain are formed with parallel straight side edges 30. One terminal link is labeled "front" and one is labeled "back" to indicate where the link is to be applied. The ends 32 of the links 12, 14, 16, 18 are semi-circular in shape and the eyelets 26 joining the links are located at the center of each semi-circular end portion.

The intermediate links 18 are adapted to fit the body in the crotch area. In the preferred form of the invention shown in the drawings, four such links are provided and each link is of a length less than half the length of the links 14, 16 in the chain. As shown, the intermediate links are provided with reference indicia consisting of the designations B-4, B-5, B-6 and B-7, respectively. Additionally, each of the intermediate links is provided with four equally spaced reference lines 34, the function of which will be described hereinafter. By reason of the symmetry of the intermediate links 18, the effective length of the garment fitting aid 10 may be varied by folding one or more of the links 18 back upon an adjacent link. In the form of the invention shown in the drawings, the chain of links may be shortened from four intermediate links 18 to two intermediate links. If desired, more than four intermediate links may be provided.

The first step in using the garment fitting aid 10 is to mark the waistline of the person being measured in some suitable manner. This may be done by tying a string 36 about the person's waist or by marking the waistline with a crayon or other device or in any other suitable manner. Once the waist has been located the inseam position for the pants pattern is next determined. To do this, the inseam position 38 is indicated on one leg of the person being fitted. If the person being fitted has flat or small hips, the inseam position should be in the center of the leg. One method of indicating the location for the inseam position is to mark the position on the person's leg in a manner that can be easily removed after it has served its purpose. If the person being measured has large or full hips, the inseam position mark should be as far forward as possible on the leg without being seen when the legs are closed.

After the two reference points 36, 38 have been established on the person being fitted, the device 10 is opened to its full length. If the length of the chain is too long for the person being fitted, the small intermediate links 18 are folded back upon themselves in the center so as to shorten the device. With the garment fitting aid 10 at the desired length, the inseam position 38 is marked on the intermediate link B-7. This marking can be made in any suitable way. One convenient manner of marking the link B-7 is to apply a paper clip 40 to the central space on the link 18 as defined by the reference lines 34. With the person being fitted wearing soft, loose-fitting undergarments, the garment fitting aid 10 is positioned between the legs and the inseam position 40 on the link B-7 is aligned with the inseam position 38 marked on the leg of the person being fitted. Starting at the crotch, each of the links 12, 14, 16, 18 in the chain is pressed close to the body, working up to the waist in the front and up to the waist at the back at the same time. In this way, the garment fitting device 10 is shaped to the particular body contours of the person being fitted.

If any difficulty is encountered in applying the garment fitting aid to the body at the front and back at the same time, the measurement can be done in two steps. The first step is to measure and shape the front portion of the device 10 by pressing the links 12, 14, 18 close to the body starting at the crotch and working up to the front waist position. This front curve may then be transferred to a pants pattern 42 in a manner to be described in detail hereinafter. In the second step, the garment fitting aid 10 is pressed closely to the body from the inseam position 40 to the back waist position. This curve is then transferred to the pants pattern in the same manner as the front curve. The two-step method of transferring the front and back body contours is recommended for persons having long torso figures.

The waist level is marked on the garment fitting aid 10 both at the front and back in any suitable manner. One method of marking the waist positions is by applying a paper clip 44 to the terminal links 12 at the free ends of the device. With the waist locations marked, the device is then carefully removed from the body of the person being fitted. Because of the friction between the individual links, there is sufficient resistance to movement to enable this to be done without difficulty. If necessary, additional resistance to movement of the links can be achieved by taping the individual links to one another.

Having determined the personal body contours of the person being fitted, the next step is to transfer these body contours to the pants pattern 42. It is customary to make pants patterns in two sections, a front section 46 and a back section 48 with the separation of the two sections occurring along the inseam line. Alignment of the garment fitting device 10 with respect to the back and front positions 46, 48 of the pants pattern is accomplished by means of the curved inner edge portions 20, 22 of the links F-2 and B-2. These two links are designated the link-up links for the front and back sections 46, 48 of the pants pattern 42, respectively. The garment fitting aid 10 is aligned first with respect to the front section 46 of the pants pattern. The pants pattern 42 is placed on a suitable working surface and the garment fitting aid 10 is placed over it. The device is then adjusted to align the curved inner edge 20 of the link-up link F-2 with the crotch seam 50 on the pattern 46. To do this, the link F-2 is positioned so that the curve 20 of the link starts at the point where the straight portion of seam 50 starts to curve. This point can be determined easily by extending the straight portion of the seam 50 with a ruler. Alignment is made when the inside curve 20 of link-up link F-2 smoothly merges with the starting point of the curve of the crotch seam 50 on the pants pattern 46. The garment fitting aid is then anchored in this position relative to the pattern by inserting push pins through the holes 28 in the eyelets 26 joining the links.

The back section 48 of the pants pattern 42 is then inserted beneath the garment fitting aid 10. With the crotch tips 52 of the two pattern sections 46, 48 aligned, the back section 48 of the pattern is moved toward the front section 46 until the inside curve 22 of link-up link B-2 smoothly merges with the starting point of the curve of the crotch seam 50. The pattern sections 46, 48 are then in place and the back section of the garment fitting aid 10 is anchored to the work surface by inserting push pins through the eyelet openings 28. When the device 10 is positioned relative to the pattern sections, the crotch tips 52 may touch, overlap or gap depending upon the particular body contours of the person being fitted.

With the garment fitting aid anchored to the work surface as described above, the links F-1, B-1 and the two terminal links 12 are moved so as to follow the straight portions of the seam line 50 on the front and back sections of the pants pattern. After completing this step, the waist level is checked and, if different from the waist indications on the patterns, is redrawn at the points indicated by the paper clips 44 on the garment fitting aid 10. In this way, the pattern style is retained and the length from the crotch inseam to the waistline is established.

Figure 7:
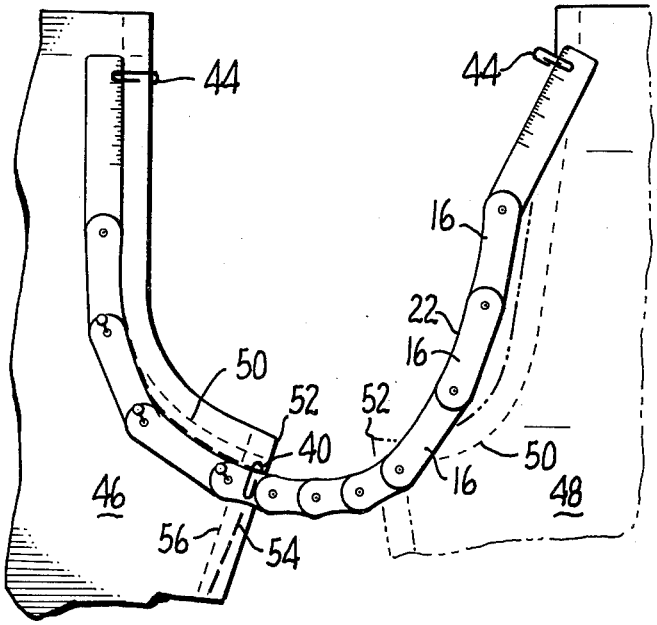
Figure 8:
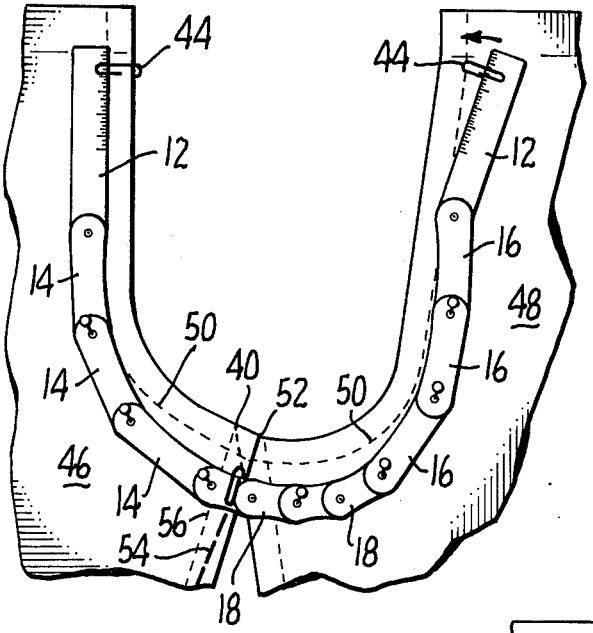
Figure 9:
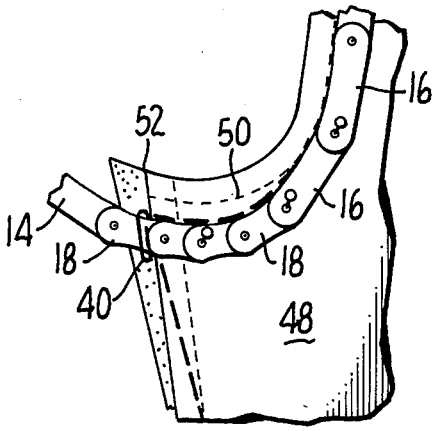
Figure 10:
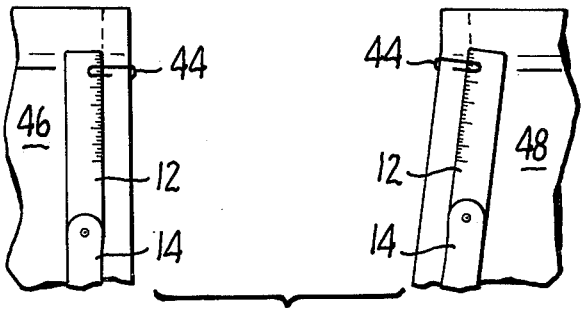

Using the inner curved edges 20, 22, 24 of the links F-2, F-3, B-2, B-3 and the intermediate links B-4, B-5, B-6 and B-7, the fitter next draws a corrected crotch line on the front and back sections 46, 48 of the pants pattern 42. If the inseam position on the corrected crotch line falls off the inseam position on the front pattern section 46, an adjustment must be made to reflect the new position. For example, if the new inseam position lies outside the inseam position on the pattern (see FIG. 7), a corrected leg seam 54 must also be drawn on the pattern. The new seam line 54 is made by a straight line drawn from the position of the paper clip 40 back to leg seam 56 on the pattern in the approximate area of the knee. Similarly, the back pattern section 48 is adjusted in the same way. In the case of the back section 48 it may be necessary to extend the pattern with tissue paper before such an adjustment can be effected.

I claim:

1. A garment fitting aid for determining body contours from the waist in front through the crotch to the waist in back, said fitting aid comprising:

a. a plurality of links, means pivotally joining together said links so as to form a chain of links with two free ends;

b. said chain of links having a first series of links with curved edge portions adapted for engagement with the front of the body;

c. a second series of links with curved edge portions adapted for engagement with the back of the body; and d. a plurality of links intermediate said first and second series of links, each of said intermediate links being shorter in length than the links in said first and second series and having opposite edge portions formed to the same curvature whereby said intermediate links may be folded back upon themselves to vary the length of the chain of links and, e. said two free ends terminating in links with straightedges with distance indicia thereon.

* * * * *